United States Patent [19]

Marchio et al.

[11] 4,114,267

[45] Sep. 19, 1978

[54] PRICE LABEL REMOVER

[76] Inventors: John P. Marchio, 2945 Denham Rd.; Hector Figueredo, 2960 Denham Rd., both of Cocoa, Fla. 32922

[21] Appl. No.: 822,534

[22] Filed: Aug. 8, 1977

[51] Int. Cl.[2] ..... A47L 25/00

[52] U.S. Cl. ..... 30/172; 15/105

[58] Field of Search ..... 30/169, 172, 171; 15/236 R, 105

[56] References Cited

U.S. PATENT DOCUMENTS

| | | | |
|---|---|---|---|
| 785,556 | 3/1905 | Kent | 30/172 |
| 1,718,496 | 6/1929 | Smith | 30/169 |
| 3,111,698 | 11/1963 | Reichle | 15/105 |
| 3,274,684 | 9/1966 | Marks | 30/171 |

*Primary Examiner*—Jimmy C. Peters

*Attorney, Agent, or Firm*—Duckworth, Hobby, Allen & Pettis

[57] ABSTRACT

A label removing device of the type primarily intended for use in removing adhesive labels from a substrate, including a unitary body portion having first and second scrapers disposed at opposite ends thereof. The first scraper is specifically designed and constructed for removing labels from a relatively hard substrate, and the second scraper is specifically designed and constructed to assist in removing adhesive labels from softer substrates.

5 Claims, 4 Drawing Figures

FIG. 1
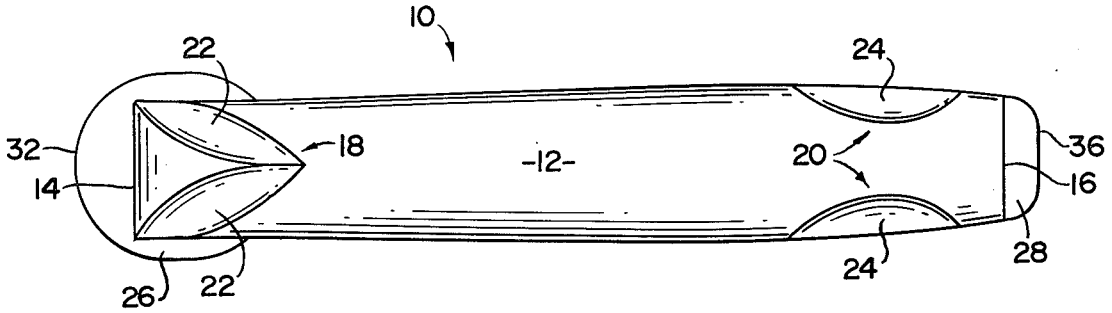
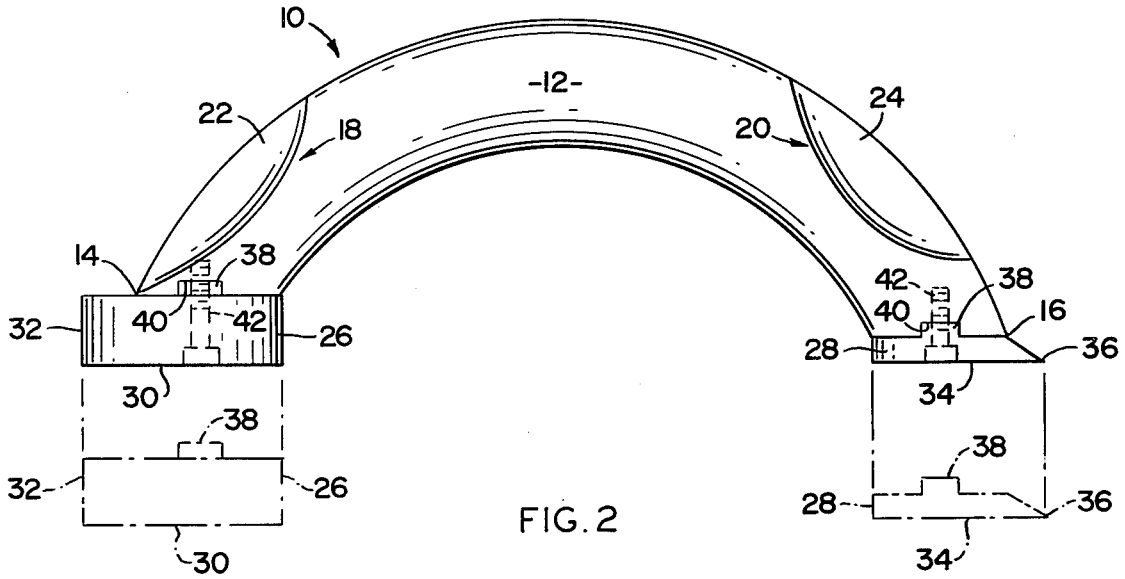
FIG. 2
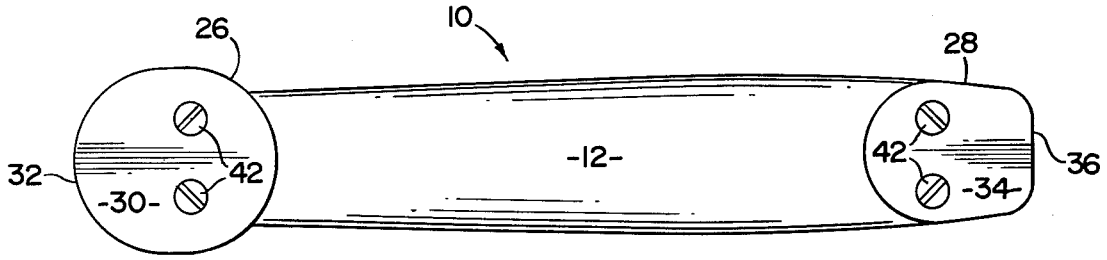
FIG. 3
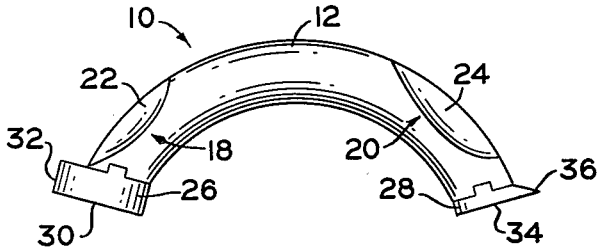
FIG. 4

PRICE LABEL REMOVER

BACKGROUND OF THE INVENTION

1. Field of the Invention

The present invention relates to a label removing device whereby adhesive labels may be conveniently removed from their substrates.

2. Description of the Prior Art

Inasmuch as ours is a retail society, the necessity and desirability of price labels on various goods purchased by the public is readily apparent. This point was recently made quite clear when large grocery chains attempted to convert to computer-readable product codes and prices. Due to opposition from the buying public, this project has at least been slowed down and the necessity of price labels on goods is as great as ever. Of course, such price labels normally take the form of small pieces of paper having an adhesive backing thereon whereby the label may be firmly attached to the product. In order to prevent customers from switching price labels within the store, it is necessary that the labels adhere quite firmly to the goods. It is this strong adhesion between the label and the substrate to which it is attached which has created certain problems.

First, if an item is purchased as a gift, it is normal practice to remove the price tag. With adhesive labels this is quite difficult. Second, it may be desirable within the retail operation to remove a label and replace it with another reflecting a different retail price. Here again, it is just as difficult for the retail personnel to remove an adhesive label from its substrate as it is for the purchaser to accomplish this operation. In recognition of this problem various scraping devices have been developed which may be utilized for the purpose of removing or cutting away a price label.

Perhaps the most common type label remover is the one which may generally be described as a handle element into which a razor blade is inserted. While such a device works well for some purpose, it does have significant drawbacks. First, the extremely sharp razor blade has a tendency to break when it is utilized in removing adhesive labels from extremely hard surfaces such as cans or glass items. Second, the sharp edge of the razor blade may damage the substrate from which the label is being removed. Finally, because the razor blade is generally held within the handle portion by a friction fit therein, the blade is subject to movement which may result in damage to the goods as well as damage to the user of the device.

Of course, other scraping devices are well known in the prior art. U.S. Pat. No. 3,363,316 to Skarsten discloses a device having a bladed portion for removing wallpaper. U.S. Pat. No. 2,634,497 to Waldesbuehl discloses a spattle spoon specifically designed for scraping the interior of bottles and jars and other items of irregular shape. U.S. Pat. No. 2,525,341 to Eicher discloses a scraping device for use in removing food from the beaters of a mixing machine. Yet another prior art device is disclosed in U.S. Pat. No. 1,224,793 to Robinson. That patent teaches the construction of a scraping device including a removably attachable scraping head comprising a plurality of blade members placed thereon, one edge of each of said blades being disposed in scraping relation to an exterior item.

However, none of the prior art discloses a device specifically designed and constructed for use in removing adhesive price labels from a variety of substrate forms. It is clear that there is a great need in the art for such a device. In recognition of the fact that adhesive price labels are affixed to various types of items, a preferred label removing device would be suitable for use in removing a label from virtually any kind of substrate. Of course, such a device should be of relatively simple construction and of a size suitable for carrying and manipulation by one hand. It would furthermore be desirable if the scraping element of the device were removably attached to the handle so that they could be replaced when worn out without the necessity of replacing the entire device.

SUMMARY OF THE INVENTION

The present invention relates to a label removing device of the type primarily intended for use in removing adhesive labels from a substrate. The device comprises a handle means formed from a unitary body portion. Opposite end portions of the body are provided in spaced apart relationship from each other. Adjacent these first and second end portions, hand positioning means comprising thumb and finger guides are formed in the body. Though not necessary, it may be desirable to form the major part of the body to include a plurality of transverse ridges so as to provide a better grip thereon by the user's hand. In a preferred embodiment of the label removing device, the body portion could be formed, for example, from a lightweight, rigid plastic material.

Disposed adjacent the first and second end portions of the device body are corresponding first and second scraper means. The first scraper means comprises a block having a planar bottom oriented for contact with the substrate from which the label is being removed. The block is removably attachable to the first end portion as by screws or other suitable fastening means. A scraping edge is provided on the block, and this scraping edge defines a convex arc with respect to the first end portion. The curved edge defined by the convex arc is substantially perpendicular to the plane of the bottom of the block so that this curved edge actually defines the scraping element. It is intended that this first scraping means be utilized in removing adhesive labels from relatively hard substrates such as cans, bottles, utensils, etc.

Correspondingly, disposed at the second end portion is a second scraper means. This second scraper means is primarily intended for use in removing adhesive labels from relatively softer substrates such as cloth, paper, boxes, etc., and is accordingly constructed to define a blade including a sharpened edge formed thereon. As with the first scraper means, the second scraper means is preferably removably attachable to the device body.

It should be obvious that by virtue of the fact that two distinct scraping elements are provided on a single body, the label removing device of this invention is extremely versatile in its use. The operator merely has to choose which end of the device is most suitable for the type of substrate from which he is removing a label and orient the device accordingly. Furthermore, by virtue of the removable attachment of the first and second scraper means to the device body, individual scraper means may be replaced as they are worn out without the necessity of replacing the entire device.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which:

FIG. 1 is a top, plan view of the label removing device.

FIG. 2 is a side, elevational view of the device with the attachment of the first and second scraper means more clearly shown in broken lines.

FIG. 3 is a bottom, plan view of the device.

FIG. 4 is a side, elevational view of an alternate embodiment of the device.

Similar reference characters refer to similar parts throughout the several views of the drawings.

DETAILED DESCRIPTION

A preferred embodiment of the label removing device of the present invention is generally indicated as 10 in the drawings of the application. As illustrated therein, device 10 comprises a handle defined by a unitary body 12 having a first end portion 14 and a corresponding second end portion 16 formed thereon in spaced apart relation one from the other.

As best seen in the views of FIGS. 1 and 2, the handle means further comprises first hand positioning means generally indicated as 18 formed in body 12 substantially adjacent first end portion 14. The corresponding second hand positioning means generally indicated as 20 is formed in body 12 substantially adjacent second end portion 16. As best seen in the view of FIG. 1, first hand positioning means 18 comprises a pair of finger guides, or depressions, 22 to properly orient the thumb and forefinger of a user in operative position on device 10. Similarly, second hand positioning means 20 comprises a pair of second finger guides, or depressions, 24. Though not illustrated in the drawings of the application, it may be desirable to form a plurality of substantially parallel ridges on body 12 in transverse relation to the longitudinal dimension thereof so as to further assist the user in firmly grasping device 10.

As best seen in the view of FIG. 2, device 10 further comprises first scraper means comprising block 26 and second scraper means comprising blade 28 removably disposed on corresponding first and second end portions 14 and 16, respectively. First scraper means comprising block 26 further includes a substantially planar bottom portion 30 for contacting the substrate from which the adhesive label is being removed. Furthermore, operatively formed on block 26 in substantially perpendicular relation to bottom portion 30 is scraping edge 32, the surface of which defines a convex arc with respect to first end portion 14. As previously stated, it is contemplated that bottom portion 30 and scraping edge 32 will be manipulated so as to remove adhesive labels from relatively hard substrate material.

Second scraper means comprising blade 28 is also formed to include a substantially flat base portion 34 disposed for engagement with the substrate, and a sharpened edge 36 operatively positioned to engage and remove the adhesive label.

As most clearly seen in the view of FIG. 2, both the first scraper means comprising block 26 and the second scraper means comprising blade 28 are removably attachable to body 12 adjacent corresponding first and second end portions 14 and 16, respectively. The view of FIG. 2 illustrates one preferred method for accomplishing this removable attachment, but, of course, the invention is not to be limited thereto. Inasmuch as the attachment structure is substantially identical for both block 26 and blade 28, similar reference characters will be used in describing the fastening means.

An attachment ledge, or nipple, 38 is formed on block 26 and blade 28 in substantially parallel relation to corresponding scraping edge 32 and sharpened edge 36. A correspondingly configured and dimensioned receptor channel 40 is formed in first end portion 14 and second end portion 16 for placement of corresponding attachment ledges 38 therein. By virtue of this construction, the proper positioning of block 26 and blade 28 onto body 12 is greatly facilitated, and, moreover, because of the ledge and channel configuration the tendency of scraping edge 32 and sharpened edge 36 to twist and deform during use is substantially eliminated. Having first placed attachment ledge 38 in its corresponding receptor channel 40, block 26 and blade 28 may be secured to body 12 by any suitable fastening means such as, for example, screws 42 as illustrated in the view of FIG. 2.

Furthermore, as best seen in the view of FIG. 4, block 26 and blade 28 are preferably angularly oriented with respect to each other so as to facilitate the use of one of the scraper means at a time. That is to say, when either block 26 or blade 28 is being utilized the other scraper means will be disposed above the substrate being scraped. It should be noted that this angular orientation may be accomplished by the orientation of bottom portion 30 and base portion 34, or by the orientation of first end portion 14 and second end portion 16, as shown in FIG. 2.

It will thus be seen that the objects set forth above, among those made apparent from the preceding description, are efficiently attained, and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A label removing device of the type primarily intended for use in removing adhesive labels from a substrate, said device comprising: handle means comprising a body having first and second end portions; first scraper means operatively disposed on said first end portion, said first scraper means comprising a block including a scraping edge formed thereon, whereby adhesive labels may be removed from a relatively hard substrate, said block further including a substantially planar bottom portion for contacting said substrate, said scraping edge defining a plane which is substantially perpendicular to said bottom portion; and second scraper means operatively disposed on said second end portion, said second scraper means comprising a blade including a sharpened edge formed thereon, whereby adhesive labels may be removed from a relatively soft substrate, said blade further including a substantially planar base for contacting said substrate, said sharpened edge being formed on said base so as to extend outwardly from said second end portion in substantially parallel relation thereto.

2. A label removing device as in claim 1 wherein said first scraper means is removably disposed on said handle means.

3. A label removing device as in claim 1 wherein said second scraper means is removably disposed on said handle means.

4. A label removing device as in claim 1 wherein said handle means further comprises first hand positioning means formed in said body substantially adjacent said first end portion and second hand positioning means formed in said body substantially adjacent said second end portion, both said first and second hand positioning means being dimensioned and configured to orient the hand of a user of said device in operative, driving relation thereto.

5. A label removing device as in claim 1 wherein the planes defined by said bottom portion and said base are angularly oriented with respect to each other, whereby only one of said first and second scraper means will contact said substrate at a time.

* * * * *